US005147744A

United States Patent [19]

Sacripante et al.

[11] Patent Number: 5,147,744

[45] Date of Patent: Sep. 15, 1992

[54] MICR PROCESSES WITH COLORED ENCAPSULATED COMPOSITIONS

[75] Inventors: Guerino G. Sacripante, Cambridge; Richard P. N. Veregin; Beng S. Ong, both of Mississauga; Padam K. Angra, Brampton, all of Canada

[73] Assignee: Xerox Corporation, Stamford, Conn.

[21] Appl. No.: 665,550

[22] Filed: Feb. 28, 1991

[51] Int. Cl.[5] ..... G03G 19/00; G03G 9/083

[52] U.S. Cl. ..... 430/39; 430/106.6; 430/110; 430/111; 430/138; 430/903

[58] Field of Search ..... 430/39, 106.6, 138, 430/903

[56] References Cited

U.S. PATENT DOCUMENTS

| | | | |
|---|---|---|---|
| Re. 33,172 | 2/1990 | Gruber et al. | 430/39 |
| 3,905,841 | 9/1975 | Simonetti . | |
| 4,108,786 | 8/1978 | Takayama et al. . | |
| 4,256,818 | 3/1981 | Blossey et al. | 430/39 |
| 4,265,993 | 5/1981 | Kawanishi et al. | 430/107 |
| 4,284,700 | 8/1981 | Oguchi et al. | 430/105 |
| 4,436,803 | 3/1984 | Ikeda et al. | 430/122 |
| 4,517,268 | 5/1985 | Gruber et al. | 430/39 |
| 4,543,312 | 9/1985 | Murakawa et al. | 430/107 |
| 4,564,573 | 1/1986 | Morita et al. | 430/109 |
| 4,600,676 | 7/1986 | Terada et al. | 430/106.6 |
| 4,623,602 | 9/1986 | Bakker et al. | 430/106 |
| 4,777,104 | 10/1988 | Matsumoto et al. | 430/109 |
| 4,803,143 | 2/1989 | Ostertag et al. | 430/106.6 |
| 4,803,144 | 2/1989 | Hosoi | 430/106.6 |
| 5,045,428 | 9/1991 | Sacripante et al. | 430/138 |

*Primary Examiner*—Roland Martin
*Attorney, Agent, or Firm*—E. O. Palazzo

[57] ABSTRACT

A colored magnetic encapsulated toner composition comprised of a core comprised of a polymer binder, magnetic metal particles, whitener, color pigment, dye or mixtures thereof, and which core is encapsulated in a polymeric shell, and wherein the toner surface comprises an optional conductive metal oxide, or metal oxides and an optional release additive, or additives.

27 Claims, No Drawings

MICR PROCESSES WITH COLORED ENCAPSULATED COMPOSITIONS

BACKGROUND OF THE INVENTION

The present invention is generally directed to toner compositions, and more specifically to colored encapsulated toner compositions. In one embodiment, the present invention is related to colored magnetic image character recognition toner compositions that can, for example, be selected for single component, and two component development, and more specifically for a number of imaging and printing processes useful for generating documents which are magnetically recognizable. More specifically, the colored encapsulated toners can be selected to develope images or characters on documents such as personal checks and other security documents which are subsequently processed in reader/sorters which are sensitive to magnetic properties of the printed images. In one embodiment of the present invention, there are provided colored toners for generating documents, such as checks, including for example dividend checks, turn around documents such as invoice statements like those submitted to customers by American Express and VISA, corporate checks, highway tickets, rebate checks, and other documents with magnetic codes thereon. In an embodiment, the present invention relates to toner compositions comprised of a polymer binder, a magnetic metal material comprised of a component with a high magnetic saturation moment of about 85 to about 400 emu per gram, and preferably from about 90 to about 200 emu per gram, a remanence of about 25 to about 300 Gauss, and preferably, from about 30 to about 200 Gauss, a coercivity of about 70 to about 1,600 Oersteds, and preferably from about 80 to about 800 Oersteds, and where the ratio of the magnetic saturation moment in emu per gram to the coercivity in Oersteds is in the range of about 2 to about 1 to 5, and preferably in the range of about 1.5 to 1 to about 1 to 3, and an average particle size of about 0.5 micron to about 6 microns, and preferably from about 0.8 to about 4 microns, a whitening agent, a color pigment, dye or mixture thereof. In one embodiment of the present invention, there are provided colored magnetic encapsulated toner compositions comprised of a core comprised of a polymer binder, a magnetic metal material comprised of a metal such as cobalt and the like of average particle size of 2 microns, a whitening agent, and a color pigment, and wherein the core is encapsulated in a polymeric coating such as a polyurea, a polyurethane, a polyamide, a polyester, or mixtures thereof, and wherein the shell contains on the surface a conductive fine powdered additive comprised of a conductive metal oxide, such as tin oxide doped with bismuth or antimony, to impart to the toner a volume resistivity of about 10,000 ohm-cm to about 1,000,000 ohm-cm suitable for ionographic imaging processes, and wherein image smearing and offsetting of the toner to read and write heads, including offsetting to the protective foil that may be present on the aforesaid heads in magnetic ink character recognition processes and apparatus inclusive of, for example, the read and write heads present in MICR (magnetic ink character recognition) reader/sorters such as the commercially available IBM 3890 TM, NCR 6780 TM, reader/sorters from Burroughs Corporation, and the like is substantially avoided or minimized. Some of the reader/sorter printers contain protective foils thereon, reference for example the IBM 3890 TM, and the problems associated with such protective foils as illustrated herein with respect to read and write heads with no foils are alleviated with the processes of the present invention. Moreover, in another embodiment the present invention related to encapsulated toner, compositions comprised of a core comprised of a low surface-energy organosilane polymer binder to minimize or remove unwanted offsetting properties, a magnetic material comprised of metals such as cobalt, a whitening agent, a color pigment, and a shell polymer which may contain a flexible structural moiety such as a polyether or polymethylene segment to improve its packing, and thus enhance resistance to core component diffusion or leaching through the toner shell structure.

Examples of advantages associated with the encapsulated compositions of the present invention in embodiments thereof include brilliant image color, and wide color variety; use thereof in many inductive single component development systems; cold pressure fixability; high image fix; nonagglomerating and excellent shelf life stability of, for example, up to 2 years in some instances; and suitability for use in magnetic ink characterization recognition technology (MICR), highlight color reprographic processes, especially xerographic and ionographic imaging and printing processes. One specific advantage of the colored toner compositions of this invention is the capability of producing MICR documents for machine readable printing, where the documents can be printed in bright color. A specific example of the advantage of these toners in printing MICR documents is to produce MICR readable characters in any color of choice. In another specific example, using the toner of this invention, an entire document comprised of a color image and a color MICR readable image can be printed in various colors using an electrophotographic imaging device with only a single development step.

The documents, including the personal checks mentioned herein, can be obtained, for example, by generating a latent image thereon and subsequently developing the image, reference U.S. Pat. No. 4,517,268 and U.S. Pat. No. Re. 33,172, the disclosures of which are totally incorporated herein by reference, with the encapsulated colored toner compositions illustrated herein. The developed image that has been created, for example, in the Xerox Corporation 9700 TM MICR printer, reference the aforesaid '268 patent, can contain thereon, for example, the characters zero, 1,2,3,4,5,6,7,8, and 9, and up to four symbols (E-13B and CMC-7 font), which characters are magnetically readable by the IBM 3890 TM, or other similar apparatus.

In one embodiment, the present invention is directed to MICR processes wherein there are selected encapsulated colored toner compositions comprised of a core comprised of a polymer resin, a cobalt magnetic pigment of high magnetic saturation and remanance, colored pigment, dye and mixture thereof, and a polymeric shell such as a polyurea, polyurethane, polyamide, polyester, or mixtures thereof.

The colored toner compositions of the present invention can, in one specific embodiment, be prepared by first dispersing the toner precursor component materials into stabilized microdroplets of controlled droplet size and size distribution, followed by shell formation around the microdroplets via interfacial polymerization, and subsequently generating the core polymer resin by addition polymerization, preferably free radical polymerization, within the newly formed microcapsules. Thus, in one embodiment, the present invention is directed to a process for the preparation of encapsulated colored MICR toner compositions, which process comprises (1) dispersing a mixture of an oil-soluble shell monomer, an addition monomer or plurality of monomers up to, for example, 25, a suitably functionalized organosilane capable of undergoing copolymerization with the core monomer, and free radical initiator(s), a magnetic pigment, whitening agent, and colorants into microdroplets in an aqueous solution of certain surfactants such as poly(vinyl alcohol) and the like; (2) subjecting the microdroplet dispersion to an interfacial polycondensation reaction by adding a water-soluble shell monomer component(s); and (3) subsequently affecting the core resin-forming addition polymerization by heating, reference for example U.S. Pat. No. 5,013,630 and U.S. Pat. No. 5,023,159, the disclosures of which are totally incorporated herein by reference.

In a patentability search report, the following United States patents are listed: U.S. Pat. Nos. 4,108,786; 4,256,818; 4,265,993; 4,543,312; 4,564,573; 4,600,676 and 4,777,104, which disclose colored toners and the use of, for example, cobalt as the magnetic ingredients, see for example column 3, beginning at line 44, of the '786 patent and note particularly column 3, at around line 53, wherein cobalt powder is disclosed as an inorganic magnetic material for the toner of the '786 patent, and also note that colored pigments such as yellow, orange, red, violet, blue, green, white and the like can be selected, see columns 4 and 5 of the aforementioned '786 patent, however, it appears that this patent is silent with respect to encapsulated toners and the use thereof in magnetic image character recognition processes; U.S. Pat. No. 4,517,268 mentioned herein; and as collateral interest U.S. Pat. Nos. 3,905,841; 4,284,700; 4,436,803 and 4,623,602. The disclosures of each of the aforementioned patents, particularly the '786, '818, '993, '312, '573, '676, '104 and '268 patents, are totally incorporated herein by reference.

Also, encapsulated and cold pressure fixable colored toner compositions are known. A number of the prior art cold pressure fixable colored toner compositions suffer from a number of deficiencies. For example, the prior art colored toners, particularly magnetic colored toners, usually do not possess sufficiently high magnetic remanance of, for example, 25 to 300 Gauss, together with high magnetic saturation moment of from about 90 to 150 emu/gram, and coercivity of from about 80 to about 800 Oersteds to be effectively useful for MICR applications. Documents generated by cold pressure fixable colored toner compositions of copending U.S. Ser. No. 546,278 (D/90069), the disclosure of which is totally incorporated herein by reference, can possess a high magnetic saturation moment, however, they lack the appropriate high remanance. The toners of the present invention are preferably useful for the generation of colored MICR documents, excluding black documents.

The following United States patents are mentioned: U.S. Pat. No. 4,803,144, which discloses an encapsulated toner with a core containing as a magnetizable substance, a magnetite, see Example 1, which is black in color; U.S. Pat. No. 4,734,350 which discloses an improved positively charged toner with modified charge additives comprised of flow aid compositions having chemically bonded thereto, or chemiadsorbed on the surface certain amino alcohol derivatives, see the Abstract for example; the disclosures of each of the aforementioned patents being totally incorporated herein by reference; and perhaps of some background interest U.S. Pat. Nos. 2,986,521; 4,051,077; 4,108,653; 4,301,228; 4,301,228 and 4,626,487.

In a patentability search report in a copending application U.S. Ser. No. 609,333 (D/90192), the disclosure of which is totally incorporated herein by reference, the following United States patents were listed: U.S. Pat. No. 4,514,484 directed to a powder suitable for developing latent images comprised of magnetic particles coated with a mixture of a thermoplastic resin and a silane, see for example the Abstract of the Disclosure; note column 3, beginning at line 15, wherein it is indicated that into the organic thermoplastic resin is incorporated a silane selected from those illustrated; U.S. Pat. Nos. 4,517,268 relating to xerographic toners for MICR printing; 4,268,598 which discloses a magnetic toner for the printing of machine readable legends; 4,748,506 relating to magnetic encapsulated toners, see column 4, wherein there is mentioned, for example, Columbia Mapico Black and Bayferrox magnetites; and 3,627,682; 4,439,510; 4,536,462 and 4,581,312, which patents disclose, for example, encapsulated toners with magnetites. The disclosures of each of the aforementioned patents are totally incorporated herein by reference.

Illustrated in copending application U.S. Ser. No. 609,316 (D/90192Q), the disclosure of which is totally incorporated herein by reference are a colored magnetic encapsulated toner composition comprised of a core comprised of a polymer binder, a colorless or light colored magnetic material, a color pigment, dye or mixture thereof excluding black, and a whitening agent, and which core is encapsulated in a polymeric shell containing therein or thereon a conductive metal oxide powder; a colored conductive magnetic encapsulated toner composition comprised of a core comprised of a polymer binder, a substantially colorless magnetic material, a color pigment, excluding black, and a whitening agent, and which core is encapsulated in a polymeric shell containing thereon a conductive metal oxide powder, and wherein the toner has a volume of from about $10^3$ ohm-cm to about $10^8$ ohm-cm; a colored magnetic encapsulated toner composition comprised of a core comprised of a polymer binder, a grayish color magnetic material, a pigment, and a whitening agent, and wherein the core is encapsulated in a polymeric shell containing a conductive metal oxide powder, and wherein the toner has a volume of from about $10^4$ ohm-cm to about $10^6$ ohm-cm, which metal oxide can be comprised of the oxides of aluminum, antimony, barium, bismuth, cadmium, chromium, germanium, indium, lithium, magnesium, molybdenum, nickel, niobium, ruthenium, silicon, tantalum, titanium, tin, vanadium, zinc, zirconium, mixtures thereof and the like.

In copending application U.S. Ser. No. 445,221 (D/89086), the disclosure of which is totally incorporated herein by reference, there are illustrated magnetic image character recognition processes with encapsulated toners wherein there is selected as the magnetite a black magnetite such as MAPICO BLACK TM. More specifically, there is illustrated in this copending application an ionographic process which comprises the generation of a latent image comprised of characters; developing the image with an encapsulated magnetic toner comprised of a core comprised of a polymer and magnetitie with a coercivity of from about 80 to about 250 Oersteds, and a remanence of from about 20 to about 70 Gauss, and wherein the core is encapsulated within a polymeric shell; and subsequently providing the developed image with magnetic ink characters thereon to a reader/sorter device whereby toner offsetting and image smearing is minimized in said device.

There is a need for magnetic image character recognition (MICR) processes enabling the generation of documents, such as personal checks, with colored encapsulated toner and developer compositions wherein toner offsetting and image smearing is avoided, and the magnetic strength signal in an embodiment are from a desirable detection range of about 75 to about 150 percent on the ON-US character. There is also a need for the generation of developed images including the generation of personal checks in laser printers or ionographic printers utilizing magnetic ink character recognition technology, wherein image offset to protective foils present on the read and write heads is avoided or minimized, and image smearing is avoided or minimized. More specifically, there is a need for colored encapsulated toners wherein image ghosting is eliminated or minimized. In addition, there is a need for colored encapsulated toner processes for generating high quality MICR images whose magnetic integrity can be maintained after many passes in MICR reading and sorting processes. Also, there is a need for pressure fixable process toners which offer high quality images with fixing levels of, for example, over 70 percent at low fixing pressure, of for example, 2,000 psi.

The aforementioned needs and others can be accomplished by the provision of colored encapsulated toners of the present invention, preferably with a high, for example 40 to 75 weight percent of magnetic metal loadings, or lightly colored metal magnetites with magnetic saturation moments of from about 70 to 120 emu per gram and remanance of about 25 to 75 Gauss to provide the desired magnetic signal strength in the MICR reader.

SUMMARY OF THE INVENTION

It is therefore a feature of the present invention to provide colored toner compositions with many of the advantages illustrated herein.

In another feature of the present invention there are provided colored magnetic encapsulated toner compositions comprised of a core of polymer binder, a color pigment or dye, metal magnetic material, and a whitener, and thereover a polymeric shell prepared, for example, by interfacial polymerization and wherein the shell can have incorporated therein, thereon, or combinations thereof certain conductive metal oxide powders.

Another feature of the present invention is the provision of colored magnetic encapsulated toners which provide brilliant colored images.

A further feature of the present invention relates to the provision of colored encapsulated toner compositions that can be selected for magnetic image character recognition processes, especially processes for generating checks, and the like with magnetic characters thereon.

Additionally, another feature of the present invention is to provide colored magnetic encapsulated toners with excellent powder flow and release properties.

Additionally, another feature of the present invention is to provide colored magnetic encapsulated toners with high magnetic saturation moments, high remanance and high coercivity.

Moreover, another feature of the present invention is the provision of colored magnetic encapsulated toners wherein the magnetic saturation moment of the toner is from about 40 to about 60 emu per gram.

In still another feature of the present invention there are provided colored magnetic encapsulated toners with a high remanance of 15 to 40 Gauss, and preferably 26 Gauss in an embodiment, and an average particle diameter of, for example, from about 1 to about 3 microns for the metal magnetites.

Moreover, another feature of the present invention is the provision of colored magnetic encapsulated toners wherein image offsetting is eliminated in some embodiments, or minimized in other embodiments.

In still another feature of the present invention there are provided colored magnetic encapsulated toners with extended shelf life.

A further feature of the present invention relates to colored magnetic encapsulated toners which are suitable for inductive single component development systems.

Another feature of the present invention is directed to pressure fixable colored magnetic encapsulated toners which offers high image fixing properties under low pressure fixing conditions.

An additional feature of the present invention is related to colored magnetic encapsulated toners which are insensitive to changes in humidity.

Another feature of the present invention resides in the provision of colored encapsulated conductive toners with a volume resistivity of from about $10^3$ to about $10^8$, and preferably from about $10^4$ to about $10^6$ ohm-cm, which toner enables developed MICR images with brilliant colors.

Another feature of the present invention resides in the provision of colored encapsulated conductive toners with a volume resistivity of from about $10^3$ to about $10^8$, and preferably from about $10^4$ to about $10^6$ ohm-cm, and wherein the shell thereof contains a very fine metal oxide powder with an average diameter of less than about 1,000 Angstroms, and more specifically from about 100 to about 1,000 Angstroms.

Additionally, in another feature of the present invention there are provided colored magnetic encapsulated toner compositions suitable for electrostatic imaging and printing apparatuses.

These and other features of the present invention can be accomplished by providing colored toner compositions, and more specifically colored magnetic encapsulated toner compositions comprised of a core of a polymer binder, a colorant, a metal magnetic material, such as cobalt and a whitener, and thereover a known polymeric shell preferably comprised of, for example, a polyether containing polyurea material, and which shell contains therein or thereon a conductive metal oxide. The encapsulated toners of the present invention can be prepared by a number of different methods including the known chemical microencapsulation processes involving a shell forming interfacial polycondensation and a core binder forming free radical polymerization. The aforementioned preparative process is comprised of (1) mixing or blending of a core monomer or monomers, up to 10, and preferably 5 in some embodiments, a free radical initiator or initiators, pigments, dyes or a mixture thereof, the magnetic material, a whitener, and an oil-soluble shell precursor or precursors; (2) dispersing the resulting mixture by high shear blending into stabilized microdroplets in an aqueous medium containing suitable dispersants or suspension agents; (3) thereafter subjecting the aforementioned stabilized microdroplets to a shell forming interfacial polycondensation by adding a water-soluble shell monomer or monomers; (4) subsequently forming the core binder by heat-induced free radical polymerization within the newly formed microcapsules; and (5) washing and drying the resulting encapsulated particles, and surface treating them with a conductive metal oxide powder to afford the colored magnetic encapsulated toner of the present invention. The shell forming interfacial polycondensation is generally accomplished at ambient temperature, about 25° C., but elevated temperatures may also be employed depending on the nature and functionality of the shell precursors selected. The core binder forming free radical polymerization is generally effected at a temperature of from ambient temperature to about 100° C., and preferably from ambient or room temperature, about 25° C. to about 90° C. In addition, more than one known initiator may be utilized to enhance the polymerization conversion, and to generate the desired molecular weight and molecular weight distribution. The surface conductivity characteristics of the toners of the present invention are primarily achieved by powder coating the toners with conductive fine powdered metal oxides or mixed oxides. Toners with conductive additives such as carbon black, titanium black and mixture thereof may not be suitable for magnetic colored toner compositions as they usually render the toners black in color, a disadvantage avoided, or minimized with the toners of the present invention in embodiments thereof. The aforementioned metal oxide surface additives of the present invention may also serve to impart the desired powder flow and surface release properties to the resultant toners.

Thus, in one embodiment the present invention is directed to a simple and economical process for pressure fixable colored magnetic encapsulated toner compositions by a chemical microencapsulation method involving a shell forming interfacial polycondensation and a core binder forming free radical polymerization, and wherein there are selected as the core binder precursors an addition-type monomer or monomers, and as shell polymer precursors, polycondensation reagents with at least one of them being oil-soluble, and at least one of them water-soluble, and which precursors are capable of undergoing condensation polymerization at the microdroplet/water interface leading to shell formation. The resultant encapsulated particles are subsequently rendered conductive by application to their surfaces of a conductive metal oxide or mixed oxide powder, which application can be accomplished by known conventional dry blending and mixing techniques. Specifically, the volume resistivity of the encapsulated toners can be reduced to a level of, for example, from about $10^3$ ohm-cm to about $10^8$ ohm-cm by blending the toner with an effective amount of, for example, from about 1 to about 15 weight percent of conductive fine metal oxide powder, which metal oxide powder has a low specific resistivity of generally less than about 1,000 ohm-cm, and more specifically less than 100 ohm-cm. Furthermore, the metal oxide powder can possess a primary particle size of less than about 1,000 Angstroms, and more specifically less than about 150 Angstroms, but greater than about 3 Angstroms.

The encapsulated toners of the present invention generally have an average particle diameter of from about 5 to about 50 microns, a saturation magnetic moment of from about 40 to about 60 emu per gram, a remanance of from about 15 to about 40 Gauss, and a volume resistivity of from about $10^3$ to about $10^8$ ohm-cm, and preferably from about $10^4$ to $10^6$ ohm-cm with the latter range of volume resistivity being particularly ideal for a number of commercial inductive single component development systems such as the Delphax printers S3000 TM, S4500 TM, and S6000 TM and the Xerox Corporation printer 4075 TM.

Embodiments of the present invention include a colored magnetic encapsulated toner composition comprised of a core comprised of a polymer binder, a metal, such as cobalt, magnetic material, a color pigment, dye or mixture thereof excluding black, and a whitening agent, and which core is encapsulated in a polymeric shell containing therein or thereon a conductive metal oxide powder; a colored conductive magnetic encapsulated toner composition comprised of a core comprised of a polymer binder, a cobalt magnetic material, a color pigment, excluding black, and a whitening agent, and which core is encapsulated in a polymeric shell containing thereon a conductive metal oxide powder, and wherein the toner has a volume of from about $10^3$ ohm-cm to about $10^8$ ohm-cm; a colored magnetic encapsulated toner composition comprised of a core comprised of a polymer binder, a magnetic cobalt material with a high saturation magnetic moment, about 90 to about 400 emu per gram, and preferably from about 90 to about 200 emu per gram, a high remanence of about 25 to about 300 Gauss, and preferably, from about 30 to about 200 Gauss, a high coercivity of about 70 to about 1,600 Oersteds, and preferably from about 80 to about 800 Oersteds, and where the ratio of the magnetic saturation moment in emu/grams to the coercivity in Oersteds is in the range of about 2 to about 1/5, and preferably in the range of about 1.5 to 1 to about 1 to 3, and an average particle size of about 0.5 to about 6 microns, and preferably from about 0.8 to about 4 microns, a pigment, and a whitening agent, and wherein the core is encapsulated in a polymeric shell containing a conductive metal oxide powder, and wherein the toner has a volume of from about $10^4$ ohm-cm to about $10^6$ ohm-cm.

Examples of core binders present in effective amounts, for example of from about 20 to about 90 weight percent, that can be selected include, but are not limited to known polymers, like addition polymers such as acrylate, methacrylate, styrene polymers and the like, which binders can be obtained by in situ polymerization of addition monomers within the microcapsules after shell formation, and wherein the monomers can be selected from the group consisting preferably of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, substituted styrenes, other substantially equivalent addition monomers, and other known addition monomers, reference for example U.S. Pat. No. 4,298,672, the disclosure of which is totally incorporated herein by reference, and mixtures thereof.

Various known colorants, or pigment present in the core in an effective amount of, for example, from about 1 to about 20 percent by weight of toner, and preferably in an amount of from about 3 to about 10 weight percent, that can be selected include Heliogen Blue L6900, D6840, D7080, D7020, Pylam Oil Blue and Pylam Oil Yellow, Pigment Blue 1 available from Paul Uhlich & Company Inc., Pigment Violet 1, Pigment Red 48, Lemon Chrome Yellow DCC 1026, E.D. Toluidine Red and Bon Red C available from Dominion Color Corporation Ltd., Toronto, Ontario, NOVAperm Yellow FGL, Hostaperm Pink E from Hoechst, Cinquasia Magenta available from E. I. DuPont de Nemours & Company, Lithol Scarlet, Hostaperm Blue, Hostaperm Red, Hostaperm Green, PV Fast Green, Cinquassi Yellow, PV Fast Blue, and the like. Generally, colored pigments that can be selected are red, blue, green, brown, cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-(octadecyl sulfonamido) phthalocyanine, x-copper phthalocyanine pigment listed in the Color Index as CI 74160, CI Pigment Blue, and Anthrathrene Blue identified in the Color Index as CI 69810, Special Blue X-2137, and the like; while illustrative examples of yellow pigments that may be selected are Diarylide Yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

Examples of typical known shell polymers include polyureas, polyamides, polyesters, polyurethanes, mixtures thereof, and other similar polycondensation products, which shell polymers may have optionally incorporated within their polymer structures certain soft and flexible segments such as polyether or polymethylene moiety. The shells are generally comprised of from about 5 to about 30 weight percent of the toner, and have a thickness generally, for example, of less than about 5 microns, but greater than about 0.5 micron. Other shell polymers, shell amounts, and thicknesses may be selected.

The oil soluble shell forming precursors present in the microdroplet phase during the microencapsulation process are preferably comprised of diisocyanates, diacyl chloride, and bischloroformate having soft and flexible moieties such as polymethylene or polyether segments within their molecular structures. Optionally, appropriate polyfunctional crosslinking agents in effective amounts, such as, for example, from about 1 to about 25 weight percent, such as triisocyanate, triacyl chloride, and the like can also be added to generate crosslinked shell polymers to improve their mechanical strength. Illustrative examples of the shell precursors include the polyether-based polyisocyanate such as Uniroyal Chemical's diphenylmethane diisocyanate-based liquid polyether VIBRATHANES, B-635 TM, B-843 TM, and the like, and toluene diisocyanate-based liquid polyether VIBRATHANES, B-604 TM, B-614 TM, and the like, and Mobay Chemical Corporation's liquid polyether isocyanate prepolymers, E-21 TM or E-21A TM, 743 TM, 744 TM, and the like, adipoyl chloride, fumaryl chloride, suberoyl chloride, succinyl chloride, phthaloyl chloride, isophthaloyl chloride, terephthaloyl chloride, ethylene glycol bischloroformate, diethylene glycol bischloroformate, triethylene glycol bischloroformate, and the like. In addition, other polyfunctional reagents can also be added as co-reactants to improve shell properties such as mechanical strength and pressure sensitivity. In one embodiment of the present invention, the aforementioned co-reactants can be selected from the group consisting of benzene diisocyanate, toluene diisocyanate, diphenylmethane diisocyanate, 1,6-hexamethylene diisocyanate, bis(4-isocyanatocyclohexyl)methane, MONDUR CB-60 TM, MONDUR CB-75 TM, MONDUR MR TM, MONDUR MRS 10 TM, PAPI 27 TM, PAPI 135 TM, ISONATE 143L TM, ISONATE 181 TM, ISONATE TM 125M TM, ISONATE 191 TM, and ISONATE 240 TM. The water-soluble shell forming monomer components which can be added to the aqueous phase include polyamine or polyol including bisphenol. Illustrative examples of the water-soluble shell monomers include ethylenediamine, tetramethylenediamine, pentamethylenediamine, 2-methylpentamethylene diamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)-triamine, tris(2-aminoethyl)amine, 4,4'-methylene bis(-cyclohexylamine), bis(3-aminopropyl)ethylene diamine, 1,3-bis(aminomethyl)cyclohexane, 1,5-diamino-2-methylpentane, piperazine, 2-methylpiperazine, 2,5-dimethylpiperazine, 1,4-bis(3-aminopropyl)piperazine, and 2,5-dimethylpentamethylene diamine, bisphenol A, bisphenol Z, and the like. When desired, a water soluble crosslinking component such as triamine or triol can also be added in effective amounts sufficient to introduce crosslinking into the shell polymer structure to improve its mechanical strength.

Examples of magnetic materials which can be selected for the toner compositions of the present invention, and which are present in an effective amount of, for example, from about 20 to about 60 weight percent have an average particle size of about 0.5 to about 6 microns, and preferably from about 0.8 to about 4 microns, include cobalt, iron, cobalt-iron alloys, cobalt alloys where the alloyed metal is selected from, but is not limited to, nickel, chromium, vanadium, maganese, magnesium, molybdenum, lead, titanium, copper, aluminum, zirconium, platinum, tungsten, gold, beryllium, or rare earth metals, and cobalt where the cobalt has been surface treated with, for example, colloidal silica, and iron alloys where the alloyed metal is selected from, but not limited to, nickel, chromium, vanadium, maganese, magnesium, molybdenum, lead, titanium, copper, aluminum, zirconium, chromium, platinum, tungsten, gold, beryllium, or rare-earth metals, and iron where the iron has been surface treated with, for example, colloidal silica.

Examples of conductive components present on the shell, and/or contained therein include powdered metal oxides and mixed oxides such as tin oxide, zinc oxide, yttrium oxide, vanadium oxide, tungsten oxide, titanium oxide, thalium oxide, tantalum oxide, silicon oxide, ruthenium oxide, rhodium oxide, platinum oxide, mixtures thereof and the like. These oxides assist in enabling the formation of a relatively conductive colored magnetic encapsulated toner wherein high quality images can be obtained. Additionally, the aforementioned conductive metal oxide powders can be surface treated with a silane agent such as, for example, hexamethyl disilazane or bis(trimethylsilyl)acetamide, and the like by exposing the oxide powders to the silane vapor at elevated temperature of, for example, 200° C. to 300° C. to improve their powder flow characteristics. The effective amount of silane agent is, for example, from about 0.1 to about 10 weight percent, and preferably from about 0.5 to 5 weight percent.

Various known suitable whitening agents can be selected such as an inorganic white powder selected from the group consisting of powdered aluminum oxide, barium oxide, calcium carbonate, calcium oxide, magnesium oxide, magnesium stearate, titanium oxide, tin oxide, zinc oxide, zinc stearate, and the like. The whitening agent is present in various effective amounts, for example from about 1 to about 20 weight percent.

In one specific embodiment of the present invention, there is provided an improved process for the preparation of colored magnetic encapsulated toner compositions, which process comprises mixing and dispersing a core monomer or monomers, a free radical initiator, colored pigment particles, dyes, or mixtures thereof, the magnetic material, a whitener, and a shell precursor or precursors into microdroplets of a specific droplet size in an aqueous medium containing a dispersant or suspension stabilizer wherein the volume average diameter of the microdroplet can be readily adjusted to be from about 5 microns to about 30 microns with its volume average droplet size dispersity being less than 1.4 as determined from Coulter Counter measurements of the microcapsule particles after encapsulation; forming a microcapsule shell around the microdroplet via interfacial polymerization by adding a water-soluble shell monomer component; and subsequently affecting a free radical polymerization to form the core binder within the newly formed microcapsules by, for example, heating the reaction mixture from room temperature to about 90° C. for a period of from about 1 to about 10 hours. Examples of known suspension stabilizers present in effective amounts of, for example, from about 0.1 to about 15 weight percent in some embodiments selected for the process of the present invention include water soluble polymers, such as poly(vinyl alcohols), methyl cellulose, hydroxypropyl cellulose, hydroxyethylmethyl cellulose, and the like. Illustrative examples of known free radical initiators selected for the preparation of the toners of the present invention include azo compounds such as 2-2'-azodimethylvaleronitrile, 2-2'-azoisobutyro-nitrile, azobiscyclohexane-nitrile, 2-methylbutyro-nitrile, or mixtures thereof with the quantity of initiator(s) being, for example, from about 0.5 percent to about 10 percent by weight of that of the core monomer(s). Interfacial polymerization processes selected for the toner shell formation and shells thereof are as illustrated, for example, in U.S. Pat. Nos. 4,000,087 and 4,307,169, the disclosures of which are totally incorporated herein by reference. After the formation of encapsulated particles, surface additive components such as zinc stearate and conductive metal oxide powders can be incorporated therein, or thereon by, for example, mixing or blending using conventional known processes. Thus, in embodiments of the present invention there can be added to the toner product surface by mixing, for example, additional known surface and flow aid additives, such as AEROSILS TM, such as AEROSIL R972 TM metal salts, metal salts of fatty acids, such as zinc stearate, and the like in effective amounts of, for example, from about 0.05 to about 3, and preferably about 1 weight percent, reference for example the United States patents mentioned herein. Examples of the aforementioned additives are illustrated in U.S. Pat. Nos. 3,590,000; 3,720,617; 3,900,588 and 3,983,045, the disclosures of which are totally incorporated herein by reference.

The disclosures of each of the United States patents mentioned herein are totally incorporated herein by reference.

In an important embodiment of the present invention there is provided a magnetic image character recognition (MICR) color process utilizing the encapsulated toners of the present invention. More specifically, in one embodiment there is provided an MICR process which comprises the generation of a latent image comprised of characters, followed by developing the image with an encapsulated magnetic toner of the present invention wherein the core of the toner is comprised of a polymer and, for example, the magnetites as illustrated herein such as cobalt or cobalt alloys, colored pigments excluding black and wherein the core is encapsulated in a polymeric shell; subsequently providing the developed image with magnetic ink characters thereon to a reader/sorter device wherein toner offsetting and image smearing is minimized or avoided in this device and wherein colored images of high image quality, that is with substantially no background deposits and wherein the colors are of a brilliant nature, can be obtained. The magnetic image character recognition process is known, as mentioned herein, particularly in the U.S. patents and reissue patents disclosed herein and these processes can be selected for the invention of the present application with the exception that with the present invention encapsulated colored toners are utilized wherein the magnetite is a specific metal such as cobalt or cobalt alloy as mentioned herein.

The following examples are being submitted to further define various aspects of the present invention. These examples are intended to be illustrative only and are not intended to limit the scope of the present invention.

EXAMPLE I

The following example illustrates the preparation of a 17.2 micron blue magnetic encapsulated toner comprised of a polyether shell, a core of poly-n-lauryl methacrylate and as magnetic material of 1 to 2 microns average particle diameter cobalt powder particles obtained from Nova Corporation with a saturation magnetic moment of 100 emg/gram, a remanence of 35 Gauss, and coercivity of approximately 130 Oersteds.

A mixture of n-lauryl methacrylate (113.0 grams, available as ROCRYL TM 320 from Rohm and Haas), ISONATE 143L TM (42.0 grams), DESMODUR E-21 TM (5.7 grams), azo-isobutyronitrile (3.0 grams, commercially available as VAZO 67 TM) was thoroughly mixed at 4,000 rpm using an IKA T-50 polytron with a G45/M probe for 30 seconds. To this mixture was added titanium dioxide powder (rutile form, 90.0 grams), cobalt powder (200 grams), and PV Fast Blue pigment (29.0 grams, available from Hoechst), followed by blending at 8,000 rpm for 3 to 5 minutes. To the resulting slurry was then added one liter of a 0.10 percent aqueous poly(vinyl alcohol) solution, and the mixture resulting was then homogenized at 9,000 rpm for 2 minutes. The resulting dispersion was transferred to a 2 liter kettle equipped with a mechanical stirrer. Bis(3-aminopropyl)piperazine (33.0 grams) was then added to the flask, and the resulting mixture was stirred for one hour at room temperature. Subsequently, the reaction mixture was heated in an oil bath with the temperature of the bath being raised from ambient temperature to 90° C. over a period of 45 minutes, and then held at this temperature for another 6 hours. After cooling to room temperature, the mixture was permitted to remain at room temperature to allow the encapsulated particle product to settle to the bottom of the reaction kettle. The particles were washed repeatedly with water until the aqueous phase was clear. The wet encapsulated particles were sieved through a 180 micron screen, and freeze dried to provide 350.0 grams of blue encapsulated particles.

A mixture of 120.0 grams of the above blue encapsulated particles as obtained above and 9.0 grams of tin oxide powder (Mitsubishi ECP-T-1) was dry blended in a Lightnin CBM dry blender at 3,000 rpm for 20 minutes, followed by sieving through a 63 micron screen. The resulting blue encapsulated toner had a volume average particle diameter of 17.2 microns and a particle size distribution of 1.33 as determined by the Coulter Counter measurement using Coulter Counter Model ZM, available from Coulter Electronics, Inc.

The volume resistivity of the toner obtained was measured by gently filling a 1 $cm^3$ cell sitting on a horseshoe magnet with the above powdered toner sample. Two opposite walls of the cell are comprised of 1 centimeter × 1 centimeter conductive metal plates. The other two walls and the bottom of the cell are also 1 centimeter × 1 centimeter in dimension, but are comprised of insulating material. A voltage of 10 volts is applied across the plates, and the current flowing through the plates is measured using an electrometer. The saturation moment is measured in a plastic cuvette of 1 cm × 1 cm × 4 cm. The device is standardized using a nickel standard whose saturation magnetic moment is known (55 emu/gram). The nickel sample is magnetized between two magnetic pole faces with a saturating magnetic field of 2,000 Gauss, such that the induced magnetic field is perpendicular to one of the faces of the cell. The integrated current that is induced when the nickel sample is removed from the saturating magnetic field is measured. Next, the integrated current induced by a toner sample under identical conditions is also measured. The encapsulated toner saturation magnetic moment is then obtained by referencing its induced current per gram of sample to that of the nickel sample. For the toner of this example, the saturation magnetic moment was measured to be 40 emu per gram, and its volume resistivity was measured to be $8.5 \times 10^6$ ohm-cm.

The remanence of the above prepared encapsulated cobalt magnetic toner was measured on a tapped powder magnetite sample in a cell of 1.0 centimeter × 1.0 centimeter × 4 centimeters. A toner sample was magnetized between two magnetic pole faces with a saturating magnetic field of 2,000 Gauss, such that the induced magnetic field was perpendicular to one of the 1 centimeter × 4 centimeters faces of the cell. The sample was removed from the saturating magnetic field, and the remanence was measured perpendicular to the above 1 centimeter × 4 centimeter face using a Hall-Effect device of a Gaussmeter, such as the F. W. Bell, Inc. Model 615 Gaussmeter. For the toner of this example, the remanance was measured to be 12 Gauss.

The above prepared toner was evaluated in Xerox 4060 TM printer. The toned images were transfixed onto paper with a transfix pressure of 2,000 psi. Print quality was evaluated from a checkerboard print pattern. The image optical density was measured with a standard integrating densitometer. Image fix was measured by the standardized scotch tape pull method, and is expressed as a percentage of the retained image optical density after the tape test relative to the original image optical density. Image smearing was evaluated qualitatively by hand rubbing the fused checkerboard print using a blank paper under an applied force for a specific cycle time, and viewing the surface cleanliness of nonprinted and printed areas of the page. Image ghosting on paper was evaluated visually. For the above prepared toner, the image fix level was 84 percent, and no image smear and no image ghosting were observed in this machine testing for at least 2,000 prints. The toner displayed a resistance to agglomeration even when heated at 55° C. for 48 hours.

For MICR evaluation, the magnetically encoded check documents were produced using the same aforementioned 4060 TM or S6000 TM Xerox or Delphax ionographic printers. The magnetic characters were generated in accordance with the E13-B font, the standard as defined by the American National Standards Institute (ANSI). The magnetic signals from the documents were tested using the MICR-MATE TM I check reader obtained from Checkmate Electronics, Inc. The ANSI standards for MICR documents are 50 to 200 percent nominal magnetic signal in an E13-B font. The magnetic signal for the MICR "On-Us" character on these check documents using the colored toner of this Example was tested using the MICR-MATE TM I check reader, and provided a value of 75 percent nominal for the blue toner at a print density of 1.05 milligrams of toner per $cm^2$.

EXAMPLE II

An encapsulated toner was prepared in accordance with the procedure of Example I, except that Lithol Scarlet pigment (35 grams) was employed instead of the PV Fast Blue pigment. The resulting dry toner (335 grams), had a volume average particle diameter of 15 microns with a volume average particle size dispersity of 1.34.

A mixture of 120.0 grams of the red encapsulated particles as obtained above and 9.0 grams of the conductive tin oxide were dry blended in a Lightnin CBM dry blender at 3,000 rpm for 20 minutes, followed by sieving through a 63 micron screen.

The above prepared toner was evaluated in Xerox 4060 TM printer as described in Example I, and for the toner of this Example II, the image fix level was 80 percent, and no image smear and no image ghosting were observed in this machine testing for at least 2,000 prints. The toner displayed a resistance to agglomeration even when heated at 55° C. for 48 hours.

The magnetic signal for the MICR "On-Us" character on the check documents using the colored toner of this Example II was tested using the MICR-MATE TM I check reader, and provided a value of 80 percent nominal for the red toner at a print density of 1.02 milligrams of toner per $cm^2$. This value is within the ANSI standards for MICR documents.

EXAMPLE III

An encapsulated toner was prepared in accordance with the procedure of Example I, except that 225 grams of Cobalt were employed. The resulting dry toner (365 grams) had a volume average particle diameter of 16 microns with a volume average particle size dispersity of 1.37.

A mixture of 120.0 grams of the blue encapsulated particle as obtained above and 9.0 grams of the conductive tin oxide were dry blended in a Lightnin CBM dry blender at 3,000 rpm for 20 minutes, followed by sieving through a 63 micron screen.

The above prepared toner was evaluated in Xerox 4060 TM printer as described in Example I, and for the toner of the Example II, the image fix level was 75 percent, and no image smear and no image ghosting were observed in this machine testing for at least 2,000 prints. The toner displayed a resistance to agglomeration even when heated at 55° C. for 48 hours.

The magnetic signal for the MICR "On-Us" character on the check documents using the colored toner of this Example III was tested using the MICR-MATE TM I check reader, and provided a value of 91 percent nominal for the blue toner at a print density of 1.13 milligrams of toner per $cm^2$. This value is within the ANSI standards for MICR documents.

EXAMPLE IV

An encapsulated toner was prepared in accordance with the procedure of Example I, except that 225 grams of Cobalt were employed, and Heliogen green (29 grams) was substituted for PV Fast Blue. The resulting dry toner (345 grams) had a volume average particle diameter of 14 microns with a volume average particle size dispersity of 1.39.

A mixture of 120.0 grams of the green encapsulated particles as obtained above and 9.0 grams of the conductive tin oxide were dry blended in a Lightnin CBM dry blender at 3,000 rpm for 20 minutes, followed by sieving through a 63 micron screen.

The above prepared toner was evaluated in Xerox 4060 TM printer as described in Example I, and for the toner of this Example IV, the image fix level was 81 percent, and no images smear and no image ghosting were observed in this machine testing for at least 2,000 prints. The toner displayed a resistance to agglomeration even when heated at 55° C. for 48 hours.

The magnetic signal for the MICR "On-Us" character on these check documents using the colored toner of this Example IV was tested using the MICR-MATE TM I check reader, and provided a value of 92 percent nominal for the green toner at a print density of 1.15 milligrams of toner per $cm^2$. This value is within the ANSI standards for MICR documents.

EXAMPLE V

An encapsulated toner was prepared in accordance with the procedure of Example I, except that 225 grams of cobalt were employed, and Microlith brown (25 grams) was substituted for PV Fast Blue. The resulting dry toner (335 grams) had a volume average particle diameter of 18 microns with a volume average particle size dispersity of 1.33.

A mixture of 120.0 grams of the brown encapsulated particles as obtained above and 9.0 grams of the conductive tin oxide were dry blended in a Lightnin CBM dry blender at 3,000 rpm for 20 minutes, followed by sieving through a 63 micron screen.

The above prepared toner was evaluated in Xerox 4060 TM printer as described in Example I, and for the toner of this Example V, the image fix level was 75 percent, and no image smear and no image ghosting were observed in this machine testing for at least 2,000 prints. The toner displayed a resistance to agglomeration even when heated at 55° C. for 48 hours.

The magnetic signal for the MICR "On-Us" character on these check documents using the colored toner of this Example V was tested using the MICR-MATE TM I check reader, and provided a value of 90 percent nominal for the brown toner at a print density of 1.00 milligram of toner per $cm^2$. This value is within the ANSI standards for MICR documents.

EXAMPLE VI

An encapsulated toner was prepared in accordance with the procedure of Example I, except that 100 grams of n-lauryl methacrylate were selected for the core and 13 grams of polydimethylsiloxane 3-methacrylo-3-aminopropyl terminated (available from Huls/Pertrarch Chemicals) was added and became part of the shell. The resulting dry toner (365 grams) had a volume average particle diameter of 15.5 microns with a volume average particle size dispersity of 1.34.

A mixture of 120.0 grams of the blue encapsulated toner particles as obtained above and 9.0 grams of the conductive tin oxide were dry blended in a Lightnin CBM dry blender at 3,000 rpm for 20 minutes, followed by sieving through a 63 micron screen.

The above prepared toner was evaluated in Xerox 4060 TM printer as described in Example I, and for the toner of this Example VI, the image fix level was 87 percent, and no image smear and no image ghosting were observed in this machine testing for at least 2,000 prints. The toner displayed a resistance to agglomeration even when heated at 55° C. for 48 hours.

The magnetic signal for the MICR "On-Us" character on these check documents using the colored toner of this Example VI was tested using the MICR-MATE TM I check reader, and provided a value of 78 percent nominal for the blue toner at a print density of 1.13 milligrams of toner per $cm^2$. This value is within the ANSI standards for MICR documents.

Other encapsulated toners can be prepared by repeating the procedure of Example I wherein, for example, n-lauryl methacrylate, about 132 grams, VAZO 52 TM, 1.5 grams, VAZO 64 TM, 1.5 grams, ISONATE 143-L TM, 42 grams, DESMODUR E-21 TM, 5.7 grams, flushed Heliogen Blue, 35 grams, obtained from BASF, 200 grams of cobalt powder (1 to 2 microns obtained from Noah Chemicals) and titanium oxide, 30 grams were selected. The resulting encapsulated blue toner had a particle size of 18 microns with a GSD of 1.41. To 120 grams of this toner were added 4 grams of conductive tin oxide, available from Mitsubishi Chemicals as ECPT-1, dopes with about 1 percent, it is believed, of antimony, and this toner had a bulk resistivity of $4.6\times10^6$ ohm-cm. To this toner was then added 1.2 grams of zinc stearate followed by dry blending for 2 minutes providing a blue toner with a resistivity of $1\times10^7$ ohm-cm, a magnetic saturation of 39 emu/gram and a remanence of 15 Gauss.

Other modifications of the present invention may occur to those skilled in the art based upon a reading of the present disclosure and these modifications are intended to be included within the scope of the present invention.

What is claimed is:

1. A colored magnetic encapsulated toner composition consisting essentially of a core comprised of a polymer binder, magnetic metal particles, whitener, color pigment, dye or mixtures thereof, and which core is encapsulated in a polymeric shell, and wherein the toner surface comprises conductive metal oxide, or metal oxides and an optional release additive, or additives; and wherein the magnetic metal particles exhibit a magnetic saturation moment of from about 85 to about 400 emu per gram, a remanence of from about 25 to about 300 Gauss, a coercivity of from about 70 to about 1,600 Oersteds, and where the ratio of the magnetic saturation moment in emu per gram to the coercivity in Oersteds is from about 2 to 1 to about 1 to 5, and wherein the average particle diameter of the toner is from about 0.5 to about 6 microns.

2. A colored toner in accordance with claim 1 wherein the magnetic metal particles are comprised of cobalt.

3. A toner composition in accordance with claim 1 wherein the magnetic particles have an average particle diameter of from about 0.8 to about 4 microns, a magnetic saturation moment of from about 90 to about 200 emu per gram, a remanence of from about 30 to about 200 Gauss, and a coercivity of from about 80 to about 800 Oersteds.

4. A toner composition in accordance with claim 1 wherein the magnetic material is selected from the group consisting of cobalt, iron, cobalt-iron alloys, cobalt alloys where the alloyed metal is selected from nickel, chromium, vanadium, manganese, magnesium, molybdenum, lead, titanium, copper, aluminum, zirconium, chromium, platinum, tungsten, gold, berylium, or rare earth metals, and iron alloys where the alloyed metal is selected from nickel, chromium, vanadium, manganese, magnesium, molybdenum, lead, titanium, copper, aluminum, zirconium, chromium, platinum, tungsten, gold, berylium, or rare earth metals.

5. A colored magnetic encapsulated toner in accordance with claim 1 wherein there is selected a conductive metal oxide fine powder comprised of an oxide of aluminum, antimony, barium, bismuth, cadmium, chromium, germanium, indium, lithium, magnesium, molybdenum, nickel, niobium, ruthenium, silicon, tantalum, titanium, tin, vanadium, zinc, or zirconium, and mixtures thereof.

6. A colored magnetic encapsulated toner in accordance with claim 1 wherein the core is derived from the polymerization of one or more addition monomers selected from the group consisting of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, and substituted styrenes.

7. A toner composition in accordance with claim 1 wherein the pigment is selected from the group consisting of Heliogen Blue, Pigment Blue 1, PV Fast Blue, Hostaperm Blue, Pigment Red 48, Lithol Scarlet, Hostaperm Red, Hostaperm Pink E, Cinquasia Magenta, Fanal Pink, Hostaperm Red, Hostaperm Green, PV Fast Green, Cinquassi Green, Microlith Brown, Bayplast Orange, mixtures thereof, and the like.

8. An encapsulated colored toner in accordance with claim 1 wherein the pigment is a cyan pigment or dye, magenta pigment or dye, a yellow pigment or dye, or mixtures thereof; blue, green, red, brown pigment or dye, or mixtures thereof.

9. A toner in accordance with claim 1 wherein the shell is comprised of a polyester, polyurea, polyurethane, polyether, polyetherurea, polyamide, or mixtures thereof.

10. A toner composition in accordance with claim 1 wherein the whitener is an inorganic white powder selected from the group consisting of powdered aluminum oxide, barium oxide, calcium carbonate, calcium oxide, magnesium oxide, magnesium stearate, titanium oxide, tin oxide, and zinc oxide.

11. An encapsulated toner in accordance with claim 1 wherein the release additive is selected from the group consisting of zinc stearate, colloidal silicas, calcium stearate, and mixtures thereof.

12. An encapsulated toner in accordance with claim 1 wherein the toner's volume resistivity is from about $10^4$ ohm-cm to about $10^6$ ohm-cm.

13. A colored magnetic toner in accordance with claim 4 wherein cobalt with an average particle size of from about 1 to 2 microns, a magnetic saturation of about 100 emu per gram, remanence of about 35 Gauss, and a coercivity of about 130 Oersteds is selected.

14. A toner in accordance with claim 1 wherein the toner is comprised of from about 3 to about 30 weight percent of shell polymer, from about 20 to about 75 weight percent of core binder, from about 1 to 20 weight percent of colored pigment, from about 20 to about 60 weight percent of magnetic material, from about 1 to about 20 weight percent of a whitening agent, from about 0.1 to about 20 weight percent of a conductive metal oxide powder, and from about 0.1 to 3 percent of a release additive.

15. A colored encapsulated toner composition in accordance with claim 1 wherein the shell is formed by interfacial polycondensation.

16. A colored encapsulated toner composition in accordance with claim 1 wherein the nominal signal measured by the MICR "ON-US" reader is about 60 percent to about 150 percent.

17. A magnetic image character recognition process which comprises developing the images or characters formed in a magnetic image character recognition process with the encapsulated toner composition of claim 1.

18. A magnetic image character recognition process which comprises developing the images or characters formed in a magnetic image character recognition process with the encapsulated toner composition of claim 2.

19. A magnetic image character recognition process which comprises developing the images or characters formed in a magnetic image character recognition process with the encapsulated toner composition of claim 4.

20. A magnetic image character recognition process which comprises the generation of a latent image comprised of characters in a magnetic image character recognition apparatus; thereafter developing the image with the encapsulated magnetic colored toner of claim 3; and subsequently providing the developed fused image with magnetic characters thereon to a reader/-sorter device.

21. A process in accordance with claim 20 wherein toner offset and image smearing is minimized in said device.

22. A process in accordance with claim 20 wherein the magnetic metal material is comprised of cobalt.

23. A process in accordance with claim 20 wherein the magnetic metal material is selected from the group consisting of cobalt, iron, cobalt-iron alloys, cobalt alloys where the alloyed metal is selected from nickel, chromium, vanadium, manganese, magnesium, molybdenum, lead, titanium, copper, aluminum, zirconium, chromium, platinum, tungsten, gold, berylium, or rare earth metals, and iron alloys where the alloyed metal is selected from nickel, chromium, vanadium, manganese, magnesium, molybdenum, lead, titanium, copper, aluminum, zirconium, chromium, platinum, tungsten, gold, berylium, or rare earth metals.

24. An imaging process which comprises generating on a substrate latent images comprised of characters with high or low speed electronic printing devices; thereafter developing the fixed image with an encapsulated magnetic toner of claim 3, and wherein the metal magnetite has a coercivity of from about 80 to about 160 Oersteds, and a remanence of from about 25 to about 55 Gauss, and wherein the core is encapsulated within a polymeric shell which includes thereon an electroconductive material; and subsequently providing the documents with magnetic ink characters thereon to a reader/sorter device whereby toner offsetting and image smearing is substantially avoided.

25. A process which comprises generating character images in an electronic ion printing device; developing the images with an encapsulated magnetic toner of claim 1 and wherein the magnetite has a coercivity of from about 80 to about 160 Oersteds, and a remanence of from about 25 to about 55 Gauss; transferring the images to a substrate; fusing the images thereto; and subsequently providing the checks with magnetic ink characters thereon to a reader/sorter device whereby toner offsetting and image smearing is substantially avoided.

26. A toner in accordance with claim 3 wherein the release additives are comprised of metal salts of fatty acids, colloidal silicas, or mixtures thereof.

27. A toner in accordance with claim 2 wherein the magnetic saturation moment is 100 emu/gram, the remanence is 35 Gauss and the coercivity is about 130 Oersteds; and wherein the metal oxide is tin oxide resulting in a toner with a volume average particle diameter of about 17 microns and a particle size distribution of about 1.33.

* * * * *